United States Patent [19]

Numbers

[11] 4,252,160

[45] Feb. 24, 1981

[54] ATTACHMENT FOR BEVERAGE FAUCETS

[75] Inventor: Jody L. Numbers, Scottsdale, Ariz.

[73] Assignee: Bernard Dale Bennett, Tempe, Ariz.

[21] Appl. No.: 42,302

[22] Filed: May 25, 1979

[51] Int. Cl.[3] ..... B65B 3/04

[52] U.S. Cl. ..... 141/98; 141/362; 251/90

[58] Field of Search ..... 141/351, 359, 360, 361, 141/362, 98; 251/90, 93

[56] References Cited

U.S. PATENT DOCUMENTS 2,201,545 5/1940 Mazzanobile ..... 141/359 X

*Primary Examiner*—Frederick R. Schmidt

*Attorney, Agent, or Firm*—Drummond and Nelson

[57] ABSTRACT

An attachment for a beverage faucet, the faucet comprised of a normally closed valve, a handle for opening the valve, and a delivery nozzle in fluid communication with the valve, which prevents the handle from opening the valve until a drinking glass is positioned beneath the faucet. The attachment consists of a bracket connected to the handle and means connected to the bracket, engaging the delivery nozzle to prevent the handle from being moved until a glass is placed below the faucet.

1 Claim, 5 Drawing Figures

ATTACHMENT FOR BEVERAGE FAUCETS

This invention relates to an attachment which provides improvements in beverage dispensing faucets.

In another respect, the invention pertains to an attachment which can be added to an existing beverage faucet for preventing flow of beverage unless and until a drinking glass is placed under the faucet.

Beverage dispensing faucets having valves which open automatically in response to a glass being placed below the faucet nozzle are well known in the art. For example, see U.S. Pat. Nos. 3,455,332 to Cornelius, 2,066,169 to Zwosta, 2,757,846 to Varrin, and 1,547,414 to Doughton. Such automatic dispensing beverage faucets are, in fact, widely used, particularly for dispensing relatively inexpensive beverages such as water, carbonated water and soft drinks.

Although such faucets could be adapted for use in dispensing more expensive beverages, particularly beer, their use in this application has either been very limited or perhaps non-existent. In fact, nearly all beer-dispensing faucets are simple manually-operated valves with a depending nozzle to deliver the beer through the valve from the nozzle into a drinking glass positioned below the nozzle.

Observations has confirmed that a very large percentage of bartenders actually open the beer-dispensing valve before the glass is under the faucet nozzle. Thus, a very significant amount of beer passing through the faucet is simply wasted and goes down the drain because the glass is not always beneath the faucet nozzle when the dispensing valve is opened.

Accordingly, it would be highly desirable to provide an attachment which could be affixed to a conventional existing beer-dispensing faucet or, for that matter, to any other existing conventional beverage-dispensing faucet which would prevent the flow of liquid from the valve nozzle until a drinking glass was positioned below the nozzle.

It would also be high desirable to provide an attachment which could be affixed to any existing conventional beverage dispensing faucet which would prevent the operation of the faucet valve opening mechanism until a drinking glass was positioned below the nozzle.

In addition, it would also be highly desirable to provide such an attachment which could be quickly and conveniently attached to existing beverage-dispensing faucets by relatively unskilled persons using only simple, conventional hand tools.

It is therefore the principal object of the present invention to provide an attachment for a beverage-dispensing faucet which would prevent the operation of the faucet valve opening mechanism until a drinking glass was positioned below the nozzle.

A further object of the invention is to provide such an attachment which can be simply and readily attached to existing beverage-dispensing faucets by persons of limited mechanical skill using conventional, simple hand tools.

These and other, further and more specific objects and advantages of the invention will be apparent to those skilled in the art from the following detailed description thereof, taken in conjunction with the drawings, in which.

Figure 1:
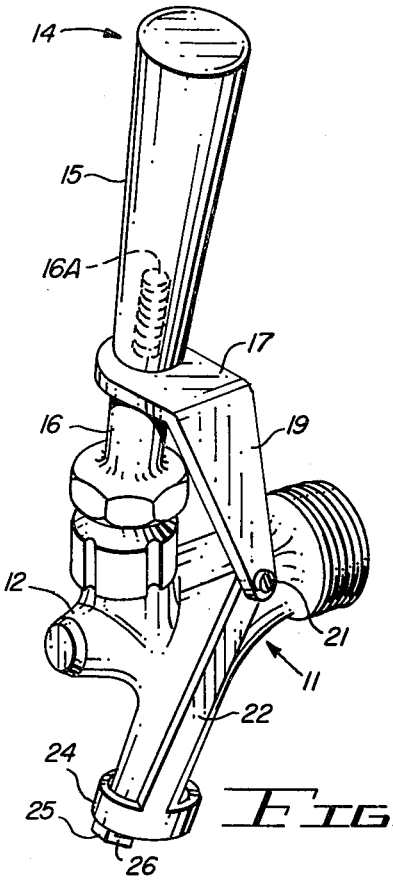
FIG. 1 is perspective view of a conventional beverage-dispensing faucet with an attachment embodying the principles of the present invention affixed to the faucet nozzle.
Figure 2:
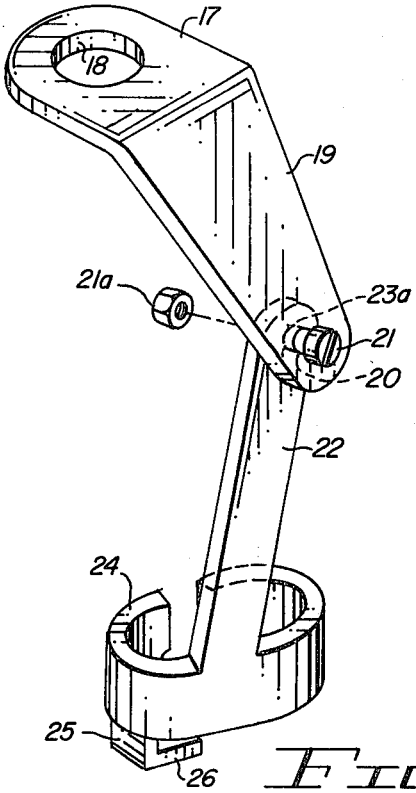
FIG. 2 is a perspective assembly view of the attachment of FIG. 1.
Figure 3:
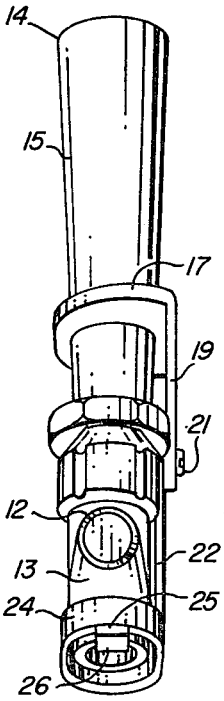
FIG. 3 is a front view of the faucet and attachment of FIG. 1.

Briefly, in accordance with my invention, I provide the combination of an existing beverage faucet, the faucet typically comprised of a normally closed valve, a valve actuating means, and a depending nozzle in fluid communication with the valve, and locking means to prevent the operation of the valve actuating means until a drinking glass is positioned beneath the nozzle. The locking means for preventing the operation of the valve actuating means until the drinking glass is positioned below th nozzle is normally engageable with the nozzle and connected to the valve actuating means and, is disengageable in response to being contacted by a drinking glass positioned beneath the nozzle.

Turning now to the drawings, which depict the presently preferred embodiment of the invention for the purpose of illustrating the practice thereof and not by way of limitation of the scope of the invention, FIGS. 1, 3, 4, and 5 illustrate a conventional beverage dispensing faucet 11 consisting of a normally closed valve 12, a depending nozzle 13 which directs the flow of beverage downwardly into a glass which may be positioned therebelow, and a manual lever 14 for opening the valve 12. The upper part 15 of the lever 14 is internally threaded to receive the threaded extension 16A of the lower port 16 of the lever 14.

FIG. 1 illustrates the attachment installed on a beverage faucet. A bracket 17 is provided with an aperture 18 which receives the threaded extension 16A of the lower part 16 of the handle 14. The bracket 17 is provided with a perpendicular downwardly depending projection 19 having a hole 20 to receive an externally threaded insert 21. A downwardly extending leg 22 with a hole 23A for receiving the insert 21 is rotatably attached to the projection 19 by screwing the internally threaded nut 21A onto the insert 21. The leg 22 is provided with a horizontal depending collar 24 which encircles the nozzle 13. The collar 24 is provided with a L-shaped downwardly depending projection 25 having an inturned horizontal leg 26 which engages the end of the nozzle 13. To install the attachment on the faucet, one first unscrewes the upper part 15 of the handle 14, slides the aperture 18 of the bracket 17 down over the threaded extension 16a, and screws the upper part 15 back onto the threaded extension 16a. Then the collar 24 is positioned on the nozzle 13 as shown in FIG. 1 and the leg 22 is pivotally attached to the projection 19 by screwing the threaded nut 21a onto the insert 21.

Figure 4:
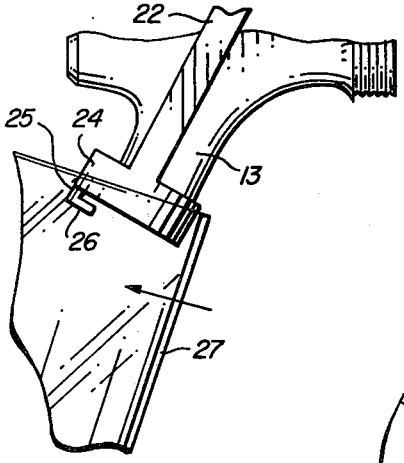
FIG. 4 is a side view of the faucet and attachment of FIG. 1 illustrating the mode of operation thereof.

As shown in FIG. 4, when a drinking receptacle 27 such as a beer glass is inserted below the nozzle 13, the lip of the glass contacts the collar 24 which displaces the horizontal leg 26 from beneath the nozzle 13 and pivots the leg 22 rewardly to permit the handle 14 to be moved.

Figure 5:
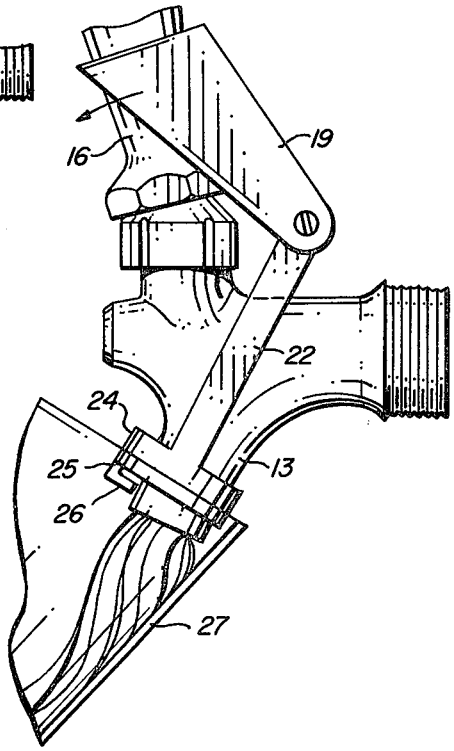
FIG. 5 is a side view of the faucet and attachment of FIG. 1 further illustrating the mode of operation thereof.

As shown in FIG. 5, after the glass 27 disengages the leg 26 from beneath the nozzle 13, the handle 14 may be operated to open the valve 12 and allow beer or other beverage to flow through the nozzle 13 into a glass 27 positioned therebelow. When the handle 14 is operated to open the valve 12, the collar 24 slides freely along the nozzle 13.

Having described my invention in such terms as to enable those skilled in the art to understand and practice it, and having identified the presently preferred embodiment thereof, I claim:

1. An attachment for existing beverage faucet, said faucet including a normally closed valve, manually operable actuating means for opening said valve, and a delivery nozzle in fluid communication with said valve for dispensing the beverage from the lower end thereof into a glass positioned therebelow, said attachment preventing the operation of said valve actuating means until a drinking glass is positioned below said nozzle and comprising (a) a support member connected to said actuating means, and (b) locking means connected to said support member and normally engaging said nozzle, and preventing operation of said actuating means until disengaged from said nozzle in response to being contacted and displaced by a drinking glass positioned beneath said nozzle.

* * * * *